US011274419B2

(12) United States Patent
Shirato et al.

(10) Patent No.: US 11,274,419 B2
(45) Date of Patent: Mar. 15, 2022

(54) WORKING MACHINE

(71) Applicant: Hitachi Construction Machinery Co., Ltd., Tokyo (JP)

(72) Inventors: Shu Shirato, Ibaraki (JP); Yoshihiro Shirakawa, Ibaraki (JP); Akihiro Narazaki, Ibaraki (JP); Katsuaki Kodaka, Ibaraki (JP)

(73) Assignee: Hitachi Construction Machinery Co., Ltd., Tokyo (JP)

( * ) Notice: Subject to any disclaimer, the term of this patent is extended or adjusted under 35 U.S.C. 154(b) by 264 days.

(21) Appl. No.: 16/490,294

(22) PCT Filed: Sep. 27, 2018

(86) PCT No.: PCT/JP2018/036148
§ 371 (c)(1),
(2) Date: Aug. 30, 2019

(87) PCT Pub. No.: WO2019/065925
PCT Pub. Date: Apr. 4, 2019

(65) Prior Publication Data

US 2021/0285185 A1 Sep. 16, 2021

(30) Foreign Application Priority Data

Sep. 29, 2017 (JP) ..... JP2017-191686

(51) Int. Cl.
*E02F 9/22* (2006.01)
*E02F 3/42* (2006.01)

(52) U.S. Cl.
CPC ..... *E02F 9/2267* (2013.01); *E02F 3/425* (2013.01); *E02F 9/2239* (2013.01); *E02F 9/2285* (2013.01); *E02F 9/2292* (2013.01)

(58) Field of Classification Search
CPC ..... E02F 9/2239; E02F 3/425; E02F 9/2285
See application file for complete search history.

(56) References Cited

U.S. PATENT DOCUMENTS 4,561,824 A * 12/1985 Okabe ..... E02F 9/2239 414/697
5,291,821 A 3/1994 Yamashita et al.
(Continued)

FOREIGN PATENT DOCUMENTS

CN 102400476 A 4/2012
JP 50-55779 A 5/1975
(Continued)

OTHER PUBLICATIONS

International Search Report (PCT/ISA/210) issued in PCT Application No. PCT/JP2018/036148 dated Dec. 18, 2018 with English translation (four (4) pages).
(Continued)

*Primary Examiner* — Michael Leslie
*Assistant Examiner* — Daniel S Collins
(74) *Attorney, Agent, or Firm* — Crowell & Moring LLP

(57) ABSTRACT

In a specific state where the raising operation of a boom 25 and the swing operation of an upperstructure 21 are performed at the same time to supply a hydraulic oil from a first pump 2 to a cylinder 7*a* through a first valve 6*a*, and to supply the same from a second pump 3 to a motor 7*b* through a second valve 6*b*, a controller 10 outputs the command current for opening a valve 13, and supplies a part of the hydraulic oil supplied to the motor 7*b* from the second pump 3 to the cylinder 7*a* through the third valve 6*c* when the motor 7*b* does not reach a steady swing state, and outputs a command current for closing the valve 13 when the motor 7*b* is in the steady swing state.

6 Claims, 11 Drawing Sheets

(56) References Cited

U.S. PATENT DOCUMENTS

| | | | | |
|---|---|---|---|---|
| 6,408,622 | B1 | 6/2002 | Tsuruga et al. | |
| 2006/0042240 | A1 | 3/2006 | Sporer et al. | |
| 2009/0056324 | A1* | 3/2009 | Itakura | E02F 9/2242 60/421 |
| 2016/0251833 | A1 | 9/2016 | Kondo et al. | |
| 2018/0305899 | A1* | 10/2018 | Kawaguchi | F02D 41/021 |

FOREIGN PATENT DOCUMENTS

| | | | |
|---|---|---|---|
| JP | 56-36774 | U | 4/1981 |
| JP | 59-88544 | A | 5/1984 |
| JP | 63-12594 | A | 1/1988 |
| JP | 64-90325 | A | 4/1989 |
| JP | 4-80158 | A | 3/1992 |
| JP | 4-194405 | A | 7/1992 |
| JP | 4-366238 | A | 12/1992 |
| JP | 6-40406 | U | 5/1994 |
| JP | 10-89304 | A | 4/1998 |
| JP | 2000-192905 | A | 7/2000 |
| JP | 2004-197825 | A | 7/2004 |
| JP | 2005-83427 | A | 3/2005 |
| JP | 2006-84022 | A | 3/2006 |
| JP | 2007-46742 | A | 2/2007 |
| JP | 2015-86959 | | 5/2015 |

OTHER PUBLICATIONS

Japanese-language Written Opinion (PCT/ISA/237) issued in PCT Application No. PCT/JP2018/036148 dated Dec. 18, 2018 (five (5) pages).

* cited by examiner

WORKING MACHINE

TECHNICAL FIELD

The present invention relates to a hydraulic drive technology of a working machine such as a hydraulic excavator provided with a front working device.

BACKGROUND ART

In a working machine provided with a front working device, there is a hydraulic drive device for supplying a sufficient amount of hydraulic oil to a boom cylinder while inhibiting a wasteful consumption of energy when a boom raising operation and a swing operation are performed at the same time. For example, Patent Literature 1 discloses a hydraulic drive device for a working machine "which includes a first hydraulic pump and a second hydraulic pump whose tilting angles can be adjusted independent of each other, a swing control valve for controlling the supply of a hydraulic oil to a swing motor, and a boom main control valve and a boom auxiliary control valve for controlling the supply of the hydraulic oil to a boom cylinder, and the swing control valve and the boom auxiliary control valve are disposed on a first bleed line, the boom main control valve is disposed on a second bleed line. A pilot pressure is output to swing control valve from the swing control valve, and the pilot pressure is output to the boom main control valve from the boom control valve. When the swing operation and the boom raising operation are performed at the same time, the boom side control valve does not output the pilot pressure to the boom auxiliary control valve (abstract excerpt)."

CITATION LIST

Patent Literature

PATENT LITERATURE 1: Japanese Patent Application Laid-Open Publication No. 2015-86959

SUMMARY OF INVENTION

Technical Problem

According to the technology disclosed in Patent Literature 1, when the boom raising operation and the swing operation are performed at the same time, the boom auxiliary control valve shuts off the supply line of the hydraulic oil from the boom auxiliary control valve to the boom cylinder. One of the hydraulic pumps is dedicated to the swing motor, and the other hydraulic pump is dedicated to the boom cylinder, and each hydraulic pump is controlled independently. As a result, a variable throttle for limiting the hydraulic oil to be supplied to the swing motor becomes unnecessary, and an energy loss of the hydraulic oil generated by throttling the opening of the variable throttle when a swing motor load pressure is smaller than a boom cylinder load pressure can be reduced.

However, even when the boom raising operation and the swing operation are performed at the same time, a large force is required for swing at the time of starting the swing, and a swing motor load pressure becomes higher than the boom cylinder load pressure. In the technology disclosed in Patent Literature 1, even under such a condition, as long as both the operations are being performed at the same time, the supply line to the swing motor and the supply line for the boom cylinder are independent of each other, so that the high swing motor load pressure may activate the swing relief valve. When the swing relief valve operates, the hydraulic oil supplied from the pump through the supply line to the swing motor is discarded to the hydraulic oil tank, which is wasteful.

The present invention has been made in view of the above circumstances, and an object of the present invention is to provide a technique of effectively leveraging an energy regardless of timing when a swing operation and a boom raising operation are performed at the same time in a working machine provided with a front working device.

Solution to Problem

According to the present invention, there is provided a working machine including: a travel base, an upperstructure that is swingably mounted on the travel base, a swing motor that drives the upperstructure, a boom that is provided in the upperstructure to be rotatable in a vertical direction, a boom cylinder that drives the boom, a hydraulic drive device that drives the swing motor and the boom cylinder, and a controller that controls the hydraulic drive device, in which the hydraulic drive device includes: a first hydraulic pump that supplies the hydraulic oil to the boom cylinder; a second hydraulic pump that supplies the hydraulic oil to the swing motor; a boom operating device that outputs a boom operating pressure which is a signal for operating the boom; a swing operating device that outputs a swing operating pressure which is a signal for operating the upperstructure; a first control valve that is disposed between the first hydraulic pump and the boom cylinder, and operates according to the boom operation to control a direction and a flow rate of the hydraulic oil supplied from the first hydraulic pump to the boom cylinder; a second control valve that is disposed between the second hydraulic pump and the swing motor and operates according to the swing operating pressure to control the direction and the flow rate of the hydraulic oil supplied from the second hydraulic pump to the swing motor; a third control valve that is disposed between the second hydraulic pump and the boom cylinder in parallel to the second control valve, and shuts off the supply of the hydraulic oil to the boom cylinder from the second hydraulic pump and operates according to the boom operating pressure to control the direction and the flow rate of the hydraulic oil supplied to the boom cylinder from the second hydraulic pump, in a state where the boom operating pressure is not introduced; an on-off solenoid valve which is disposed between the boom operating device and the third control valve and opens and closes based on a command current from the controller; and a relief valve that is provided between the second hydraulic pump and the swing motor, and in a specific state in which the boom raising operation and the swing operation of the upperstructure are performed at the same time to supply the hydraulic oil from the first hydraulic pump to the boom cylinder through the first control valve, and to supply the hydraulic oil from the second hydraulic pump to the swing motor through the second control valve, the controller outputs the command current for opening the on-off solenoid valve for introducing the boom operating pressure to the third control valve, supplies a part of the hydraulic oil supplied to the swing motor from the second hydraulic pump to the boom cylinder through the third control valve in case it is discriminated that the swing motor does not reach a steady swing state, and the controller outputs the command current for closing the on-off solenoid valve for limiting introduction of the boom operating pressure into the third control valve in case where it is discriminated that the swing motor is in the steady swing state.

Advantageous Effects of Invention

According to the present invention, in a working machine provided with a front working device, an energy can be efficiently used regardless of timing when the swing operation and the boom raising operation are performed at the same time. In addition, the problems, configurations and effects except for those described above will be clarified by description of the following embodiment.

DESCRIPTION OF EMBODIMENTS

Hereinafter, the embodiments of the present invention will be described with reference to the drawings. In each of the following embodiments, a hydraulic excavator will be described as an example of a working machine driven by a hydraulic drive device.

First Embodiment

In the present embodiment, in a hydraulic drive device for a hydraulic excavator including a first hydraulic pump and a second hydraulic pump, when a boom raising operation and a swing operation are performed at the same time, the independence and non-independence of both those pumps are controlled taking the magnitude of a load pressure of actuators for both the operations into consideration.

Specifically, for example, as in a swing start, when a load pressure of the swing motor is larger than a load pressure of the boom raising operation, both those pumps are made independent of each other. On the other hand, in a state where a predetermined time elapses from the swing start, and a large force for swing is not required, both the pumps are made independent of each other.

Hereinafter, a state in which the boom raising operation and the swing operation are simultaneously performed is referred to as a swing boom raising operation.

Figure 1:
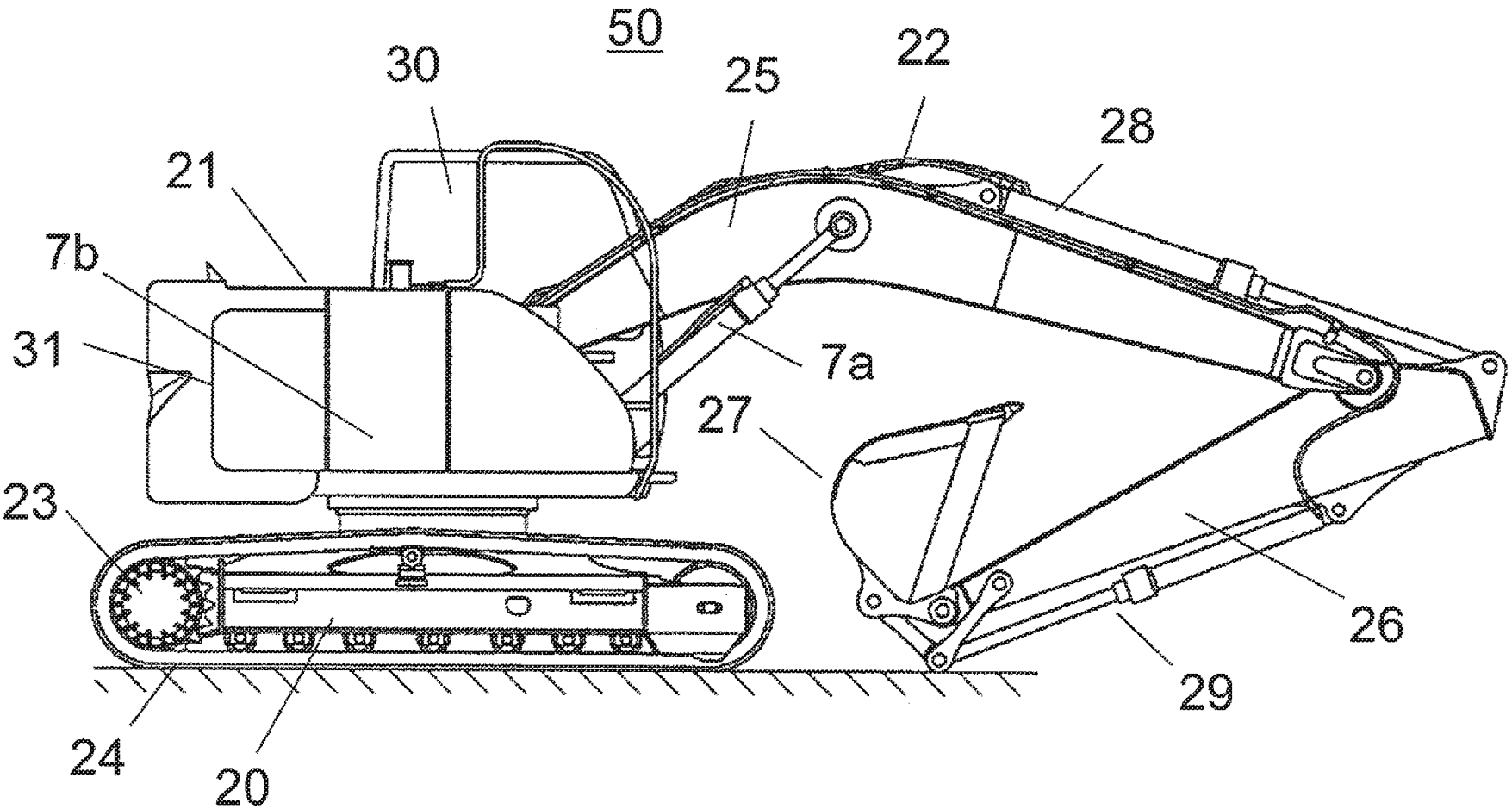
FIG. 1 is a side view of a hydraulic excavator according to a first embodiment.

First, an overview of the hydraulic excavator according to the present embodiment will be described. FIG. 1 is a side view of a hydraulic excavator 50 according to the present embodiment.

As shown in the figure, the hydraulic excavator 50 according to the present embodiment includes a travel base 20, an upperstructure 21 swingably mounted on the travel base 20, a swing motor 7*b* for driving the upperstructure 21, a front working device 22 liftably connected to the upperstructure 21, a cab 30 provided at the front of the upperstructure 21 and a driving source chamber 31 provided at the rear of the upperstructure 21.

The front working device 22 includes a boom 25 connected to the upperstructure 21, a boom cylinder 7*a* for driving the boom 25, an arm 26 connected to a tip of the boom 25, an arm cylinder 28 for driving the arm, a bucket 27 connected to a tip of the arm 26, and a bucket cylinder 29 for driving the bucket 27.

Each of the swing motor 7*b*, the boom cylinder 7*a*, the arm cylinder 28, and the bucket cylinder 29 is a hydraulic actuator that operates by a hydraulic oil supplied from a hydraulic pump to be described later.

Moreover, the hydraulic excavator 50 is provided with a hydraulic drive device which drives those hydraulic actuators, and a controller which controls the hydraulic drive device. The hydraulic drive device and the controller are disposed, for example, in the driving source chamber 31. The hydraulic drive device and the controller will be described later.

A pair of travel bases 20 is provided on the left and right. Each of the left and right travel bases 20 includes a traveling motor 23 and a crawler 24. In this example, only one travel base is illustrated. The crawler 24 is driven by the traveling motor 23 to cause the hydraulic excavator 50 to travel.

[Hydraulic Drive Circuit]

Figure 2:
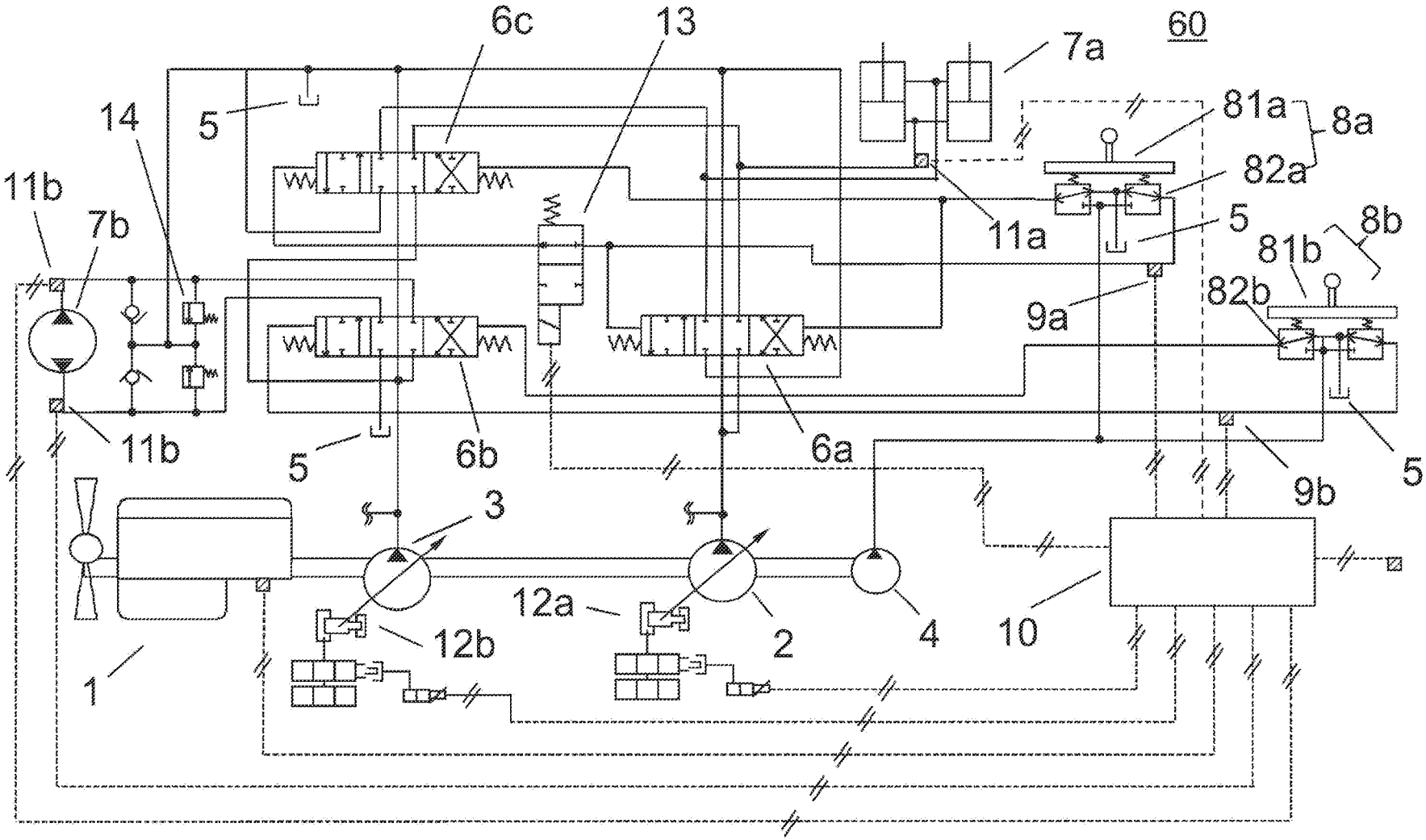
FIG. 2 is a block diagram of a hydraulic drive device according to the first embodiment.

Next, the hydraulic drive device 60 according to the present embodiment will be described. FIG. 2 is a block diagram of the hydraulic drive device 60 according to the present embodiment.

As described above, in the present embodiment, the hydraulic drive device 60 is provided which efficiently use an energy when the swing operation by the swing motor 7*b* and the boom raising operation by the boom cylinder 7*a* are performed at the same time. For that reason, in this example, the swing motor 7*b* and the boom cylinder 7*a* are shown as the hydraulic actuators.

The hydraulic drive device 60 includes a prime mover (for example, an engine) 1, a first hydraulic pump 2, a second hydraulic pump 3, and a pilot pump 4, which are driven by the prime mover 1, and a controller 10 that controls the respective devices in the hydraulic drive device 60.

The first hydraulic pump 2 supplies the hydraulic oil to the boom cylinder 7*a*. The second hydraulic pump 3 mainly supplies the hydraulic oil to the swing motor 7*b*.

The first hydraulic pump 2 and the second hydraulic pump 3 are swash plate type or inclined shaft type variable displacement hydraulic pumps. The first hydraulic pump 2 includes a first regulator 12*a* that adjusts a tilting angle of the swash plate or the inclined shaft of the first hydraulic pump 2. Similarly, the second hydraulic pump 3 includes a second regulator 12*b* that adjusts the same tilting angle.

Further, the hydraulic drive device 60 includes a boom operating device 8*a* which outputs a boom operating pressure which is a signal for operating the boom 25 and a swing operating device 8*b* which outputs a swing operating pressure which is a signal for operating the upperstructure 21.

The boom operating device 8*a* and the swing operating device 8*b* include control levers 81*a* and 81*b* for receiving a boom operation by an operator, and control valves 82*a* and 82*b* for outputting a boom operating pressure according to a manipulated variable by the control levers 81*a* and 81*b*, respectively.

The control levers 81*a* and 81*b* are provided in the cab 30. The control valves 82*a* and 82*b* are connected to the pilot pump 4, use a delivery pressure of the pilot pump 4 as an original pressure, and generate and output an operating pressure corresponding to the manipulated variable as a boom operating pressure and a swing operating pressure.

Further, the hydraulic drive device 60 includes a first control valve 6*a*, a second control valve 6*b* and a third control valve 6*c* which control a direction and a flow rate of the hydraulic oil, a boom operating pressure cut valve 13 which is an on-off solenoid valve that opens and closes based on a command current from the controller 10, and a swing relief valve 14 that protects a supply path of the hydraulic oil to the swing motor 7*b* from an excessive pressure.

The first control valve 6*a* is disposed between the first hydraulic pump 2 and the boom cylinder 7*a*, and operates according to the boom operating pressure, and controls the direction and the flow rate of the hydraulic oil supplied from the first hydraulic pump 2 to the boom cylinder 7*a*.

The second control valve 6*b* is disposed between the second hydraulic pump 3 and the swing motor 7*b*, and operates according to the swing operating pressure, and controls the direction and the flow rate of the hydraulic oil supplied from the second hydraulic pump 3 to the swing motor 7*b*.

The third control valve 6*c* is provided between the second hydraulic pump 3 and the boom cylinder 7*a* in parallel to the second control valve 6*b*. Then, the third control valve 6*c* operates according to the boom operating pressure to control the direction and flow rate of the hydraulic oil supplied from the second hydraulic pump 3 to the boom cylinder 7*a*. The third control valve 6*c* shuts off the supply of the hydraulic oil from the second hydraulic pump 3 to the boom cylinder 7*a* when the boom operating pressure is not introduced.

The boom operating pressure cut valve 13 is disposed between the boom operating device 8*a* and the third control valve 6*c*, and restricts the boom operating pressure based on a command current from the controller.

The swing relief valve 14 is provided between the second hydraulic pump 3 and the swing motor 7*b* to protect the supply path of the hydraulic oil to the swing motor 7*b* from an excessive pressure. The swing relief valve 14 operates when reaching a set pressure (set pressure), opens a circuit leading to the hydraulic oil tank 5, allows the hydraulic oil in the circuit to flow into the hydraulic oil tank 5, and reduces a pressure in the circuit.

The controller 10 receives each sensor signal and controls each part of the hydraulic excavator 50. In the present embodiment, a cut valve control process is performed to control the opening and closing of the boom operating pressure cut valve 13 according to the operating pressure and the load pressure. For example, the controller 10 receives a boom operating pressure from the boom operating pressure sensor 9*a*, the swing operating pressure from the swing operating pressure sensor 9*b*, the boom load pressure from the boom cylinder pressure sensor 11*a*, and the swing load pressure from the swing motor pressure sensor 11*b*, and when a predetermined condition is satisfied, the controller 10 outputs a close command to the boom operating pressure cut valve 13.

Specifically, at the time of the swing boom raising operation, in a specific state in which the hydraulic oil is supplied from the first hydraulic pump 2 to the boom cylinder 7*a* through the first control valve 6*a*, and the hydraulic oil is supplied from the second hydraulic pump 3 to the swing motor 7*b* through the second control valve 6*b*, if the swing load pressure is equal to or higher than the boom load pressure, the controller 10 outputs a command current so as to open the boom operating pressure cut valve 13 in order to introduce the boom operating pressure to the third control valve 6*c*. As a result, the controller 10 supplies a part of the hydraulic oil supplied from the second hydraulic pump 3 to the swing motor 7*b* to the boom cylinder 7*a* through the third control valve 6*c*. On the other hand, when the swing load pressure is smaller than the boom load pressure, the controller 10 outputs the command current so as to close the boom operating pressure cut valve 13 in order to restrict the introduction of the boom operating pressure to the third control valve 6*c*.

Hereinafter, in the present embodiment, the command current to be output to open the boom operating pressure cut valve 13 is called "open command", and the command current to be output to close the boom operating pressure cut valve 13 is called "close command". In the present embodiment, a current value of the open command is set to 0. In other words, when no current is output, the boom operating pressure cut valve 13 passes the boom operating pressure as it is, and shuts off the boom operating pressure when a closing command is received.

The controller 10 is realized by an arithmetic device including a central processing unit (CPU), a random access memory (RAM), and a storage device such as a read only memory (ROM) or a hard disk drive (HDD).

In the cut valve control process, the controller 10 first determines whether or not the swing motor 7*b* is in the swing boom raising operation, based on whether or not the boom operating pressure and the swing operating pressure are received. When it is determined that the swing motor 7*b* is in the swing boom raising operation, the controller 10 determines whether the operation is immediately after the start of the swing boom raising operation or the second half of the operation. When it is determined that the operation is in the second half of the operation, the controller 10 outputs a command (close command) for closing the valve to the boom operating pressure cut valve 13.

Immediately after the start of the swing boom raising operation, as described above, a large force is required to start the swing motor 7*b*. On the other hand, during the second half of operation, a large force is not required for the swing motor 7*b*. A state of the swing motor 7*b* when the large force at the second half of the operation is no longer required is referred to as "a steady swing state". In the present embodiment, the magnitudes of the boom load pressure and the swing load pressure are compared with each other, and when the boom load pressure is larger than the swing load pressure, it is assumed that the swing motor 7*b* is in the steady swing state.

Figure 3:
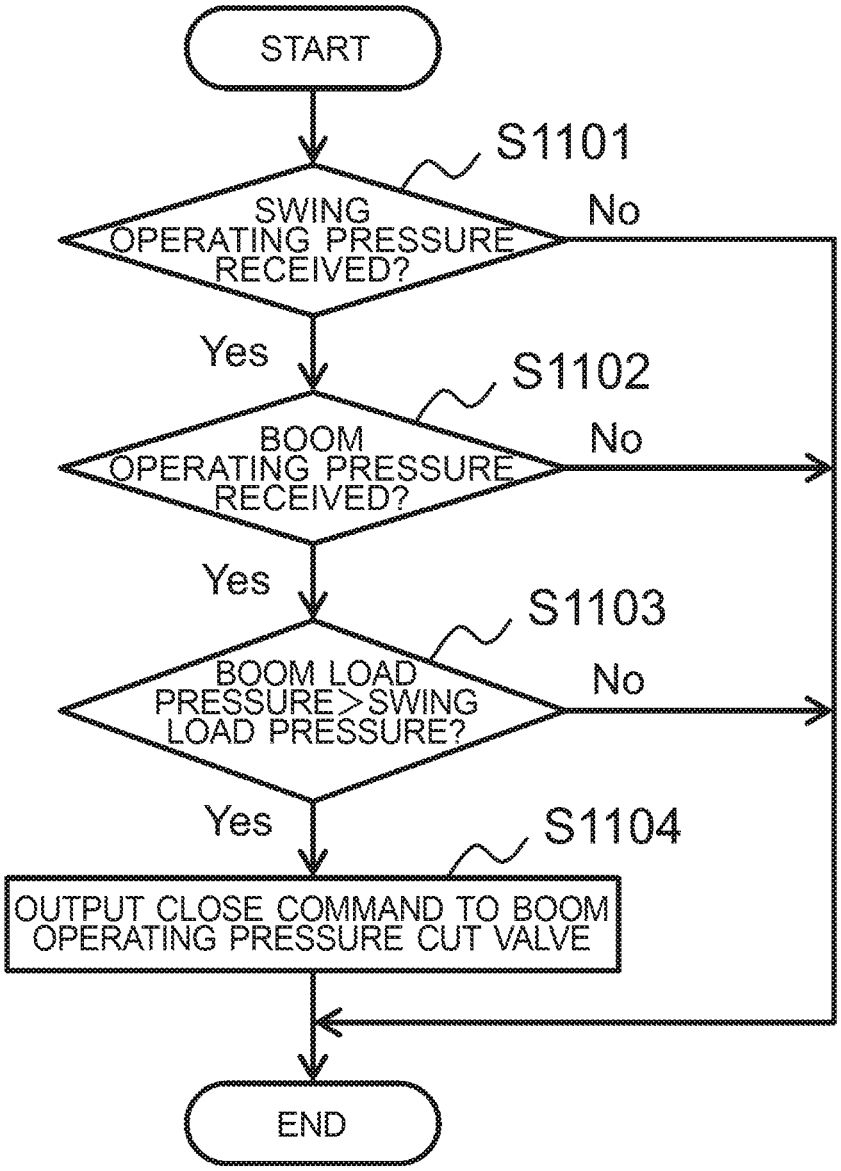
FIG. 3 is a flowchart of a cut valve control process according to the first embodiment.

Hereinafter, a flow of the cut valve control process by the controller 10 will be described according to a flow of FIG. 3. The cut valve control process is performed at predetermined time intervals. Further, before the start of processing, the boom operating pressure cut valve 13 is in an open state.

First, the controller 10 determines whether or not the swing operation has been performed (Step S1101). As described above, when the swing operating pressure is received from the swing operating pressure sensor 9*b*, the controller 10 determines that the swing operation has been performed. Then, when it is not determined that the swing operation has been performed, the process is completed.

If it is determined that the swing operation has been performed, the controller 10 determines whether or not the boom operation has been performed (Step S1102). As described above, when the boom operating pressure is received from the boom operating pressure sensor 9*a*, the controller 10 determines that the boom operation has been performed. Then, if it is not determined that the boom operation has been performed, the processing is completed.

If it is determined that the boom operation has been performed, the controller 10 compares the boom load pressure with the swing load pressure (Step S1103).

As a result of comparison, when the boom load pressure is larger than the swing load pressure, the controller 10 outputs the close command to the boom operating pressure cut valve 13 (Step S1104), and the process is ended. The controller 10 is configured to discriminate that the swing motor 7*b* is in the steady swing state when the boom load pressure is larger than the swing load pressure.

On the other hand, when the boom load pressure is equal to or less than the swing load pressure, the process is completed as it is. In that case, the controller 10 determines that the swing motor 7*b* is at the start of swing where a large load is applied to the swing motor 7*b* and that the swing motor 7*b* does not reach the steady swing state.

Note that either of Steps S1101 and S1102 may be performed first.

Next, the operation of the hydraulic drive device 60 according to the present embodiment when the above control is performed will be described with reference to FIGS. 4 and 5. In the figure, lines through which the hydraulic oil flows are indicated by thick lines. Moreover, lines through which the pilot pressure oil flows due to the operating pressure are indicated by alternate long and short dash lines.

As shown in the figure, at the time of the boom raising operation, a boom raising operating pressure da is generated by operating the control lever 81*a* (the boom operating device 8*a*) in a right direction in the figure. Due to the boom raising operating pressure da, the first control valve 6*a* strokes from a neutral position to the right in the figure, and the hydraulic oil of the first hydraulic pump 2 flows into the bottom side of the boom cylinder 7*a*.

Further, at the time of the swing operation, a swing operating pressure db (swing operating device 8*b*) is generated by operating the control lever 81*b* (swing operating device 8*b*) in a first direction. With the swing operating pressure db, the second control valve 6*b* strokes to the right in the drawing, and the hydraulic oil of the second hydraulic pump 3 is supplied to the swing motor 7*b* and returns to the hydraulic oil tank 5 through the second control valve 6*b*.

Upon detecting the boom raising operating pressure da, the boom operating pressure sensor 9*a* outputs the detected boom raising operating pressure da to the controller 10. In the same manner, upon detecting the swing operating pressure db, the swing operating pressure sensor 9*b* outputs the detected swing operating pressure db to the controller 10. Further, the boom cylinder pressure sensor 11*a* detects a boom load pressure Pa, and the swing motor pressure sensor 11*b* detects a swing load pressure Pb, and those sensors 11*a* and 11*b* output the detected load pressures to the controller 10.

At the start of the swing boom raising operation, as described above, the swing load pressure Pb is equal to or higher than the boom load pressure Pa (Pb≥Pa). For that reason, the controller 10 does not output a close command cc to the boom operating pressure cut valve 13. Thus, the boom operating pressure cut valve 13 is in an open state.

Figure 4:
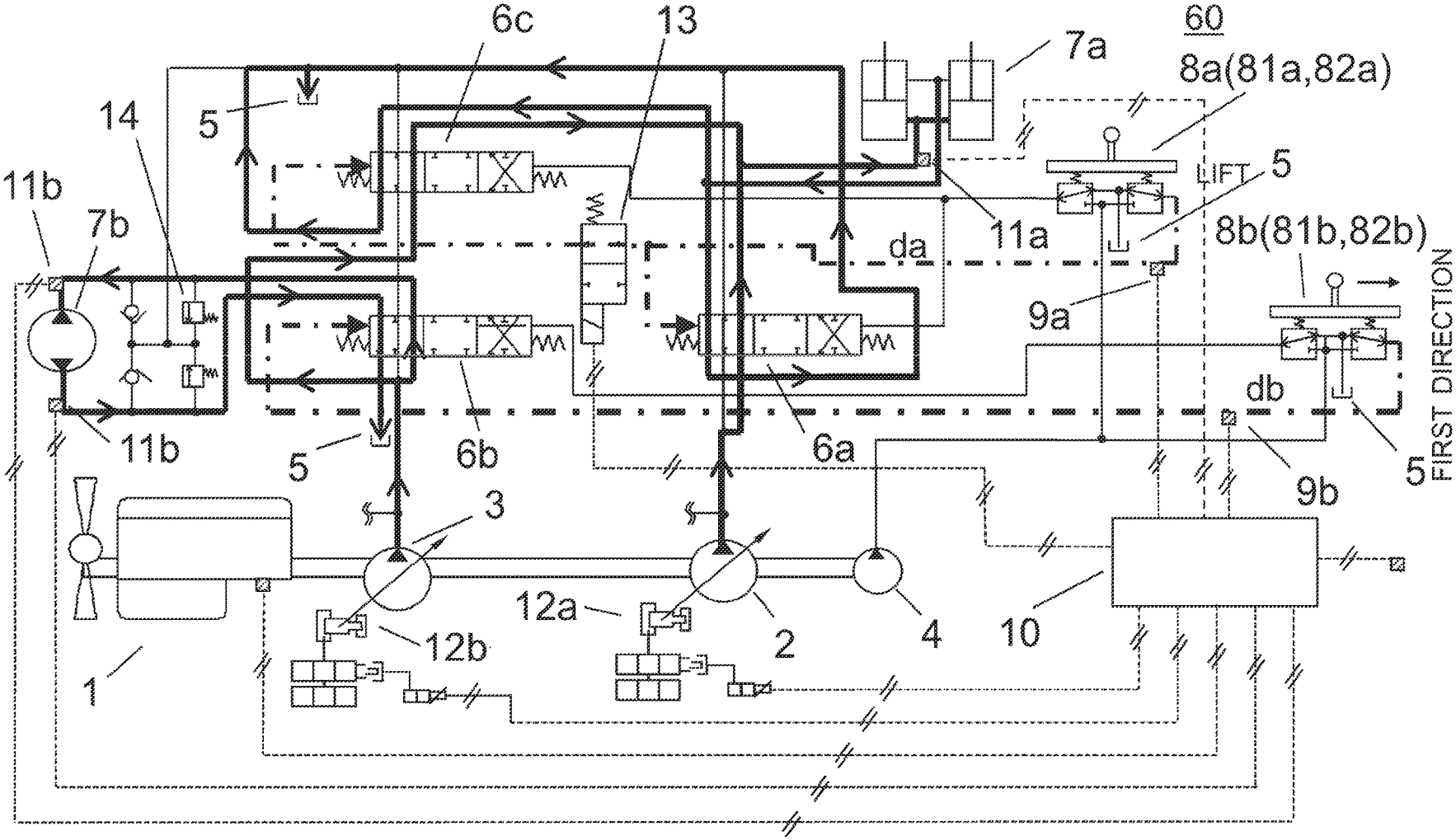
FIG. 4 is an illustrative view illustrating the operation of the hydraulic drive device according the first embodiment.
Figure 5:
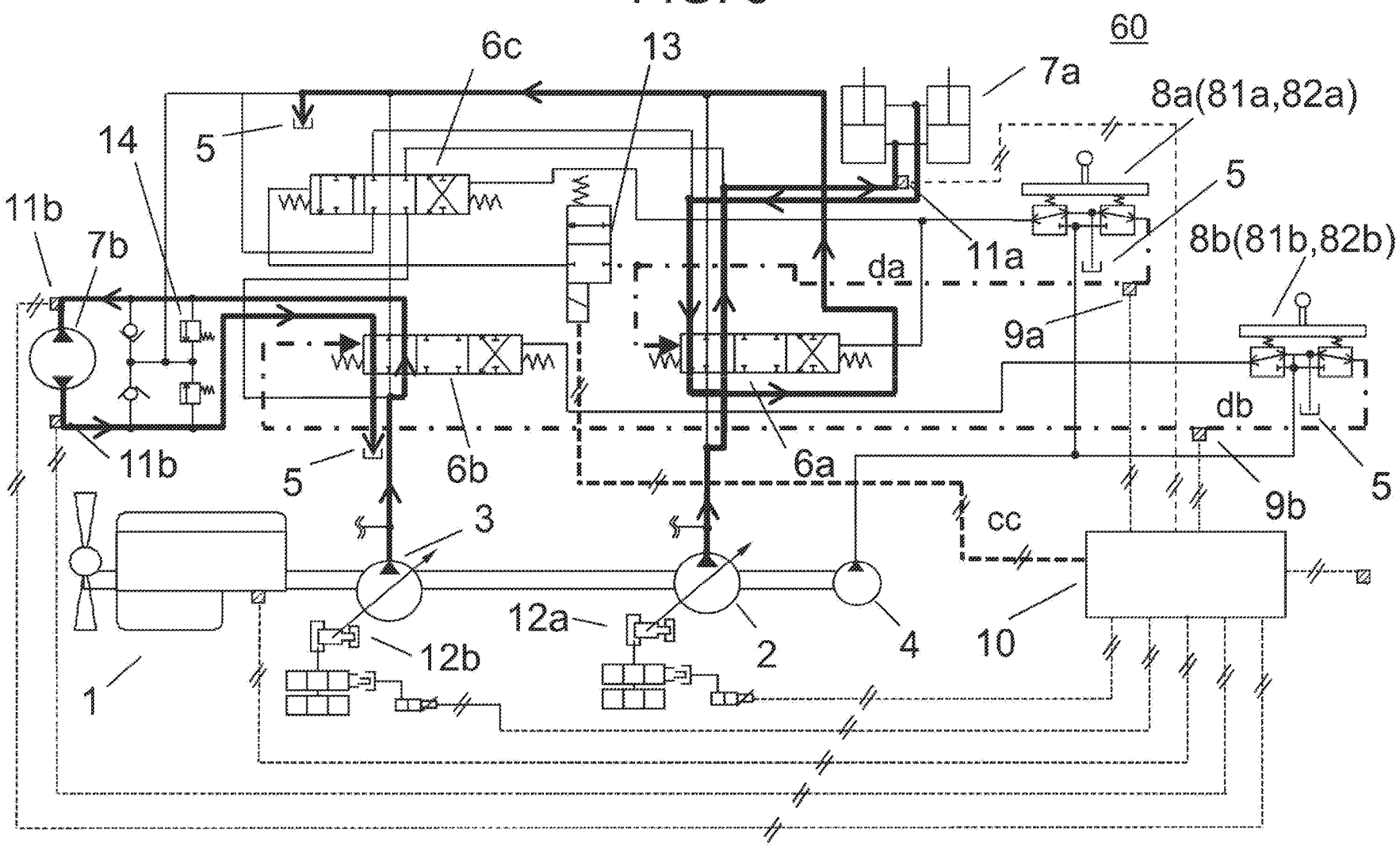
FIG. 5 is an illustrative view illustrating the operation of the hydraulic drive device according to the first embodiment.

Therefore, at the start of the swing boom raising operation, as shown in FIG. 4, the boom raising operating pressure da also acts on the third control valve 6*c*, and causes the third control valve 6*c* to stroke to the right in the figure. As a result, the hydraulic oil of the second hydraulic pump 3 also flows into a bottom side of the boom cylinder 7*a*.

As described above, when the swing load pressure Pb is equal to or higher than the boom load pressure Pa, the hydraulic oil of the second hydraulic pump 3 is supplied to both the swing motor 7*b* and the boom cylinder 7*a*.

At that time, the hydraulic oil delivered from the rod side returns to the hydraulic oil tank 5 through the third control valve 6*c* and the first control valve 6*a*.

On the other hand, when the rotation of the swing motor 7*b* is in a steady swing state, the swing load pressure Pb decreases and becomes smaller than the boom load pressure Pa (Pb<Pa). At that time, the controller 10 outputs the close command cc to the boom operating pressure cut valve 13 as shown in FIG. 5.

As shown in the figure, when the close command cc is output, the boom operating pressure cut valve 13 shuts off the boom raising operating pressure da acting on the third control valve 6*c*. As a result, the third control valve 6*c* does not stroke and is in a neutral state. For that reason, the hydraulic oil from the second hydraulic pump 3 is not supplied to the boom cylinder 7*a*.

At that time, as in FIG. 4, the boom raising operating pressure da acts on the first control valve 6*a* to lead the hydraulic oil of the first hydraulic pump 2 to the cylinder bottom side of the boom cylinder 7*a*. Further, the swing operating pressure db acts on the second control valve 6*b*, and leads the hydraulic oil of the second hydraulic pump 3 to the swing motor 7*b*.

This makes it possible to realize an independent circuit in which the first hydraulic pump 2 is dedicated to the boom cylinder 7*a* and the second hydraulic pump 3 is dedicated to the swing motor 7*b*. In this way, the boom operating pressure cut valve 13 is switched, thereby being capable of realizing an independent circuit and a parallel circuit.

As described above, according to the present embodiment, in the hydraulic drive device 60 for the hydraulic excavator 50, the boom operating pressure cut valve 13 is opened in order to introduce the boom operating pressure to the third control valve 6*c* to supply a part of the hydraulic oil to be supplied from the second hydraulic pump 3 to the swing motor 7*b* to the boom cylinder 7*a* through the third control valve 6*c* when the swing load pressure is equal to or more than the boom load pressure, in the specific state where, at the time of the swing boom raising operation, the hydraulic oil is supplied from the first hydraulic pump 2 to the boom cylinder 7*a* through the first control valve 6*a*, and the hydraulic oil is supplied from the second hydraulic pump 3 to the swing motor 7*b* through the second control valve 6*b*. Also, when the swing load pressure becomes less than the boom load pressure, it is discriminated that the swing motor 7*b* is in the steady swing state, and the close command is output so as to close the boom operating pressure cut valve 13 in order to restrict the introduction of the boom operating pressure to the third control valve 6*c*.

The hydraulic excavator 50 requires a large swing force particularly at the start of swing, because the moment of inertia of the upperstructure 21 is large at the time of swing. Even when the boom raising operation and the swing operation are performed at the same time, the swing load pressure is larger than the boom loading pressure at the start of swing.

Figure 6:
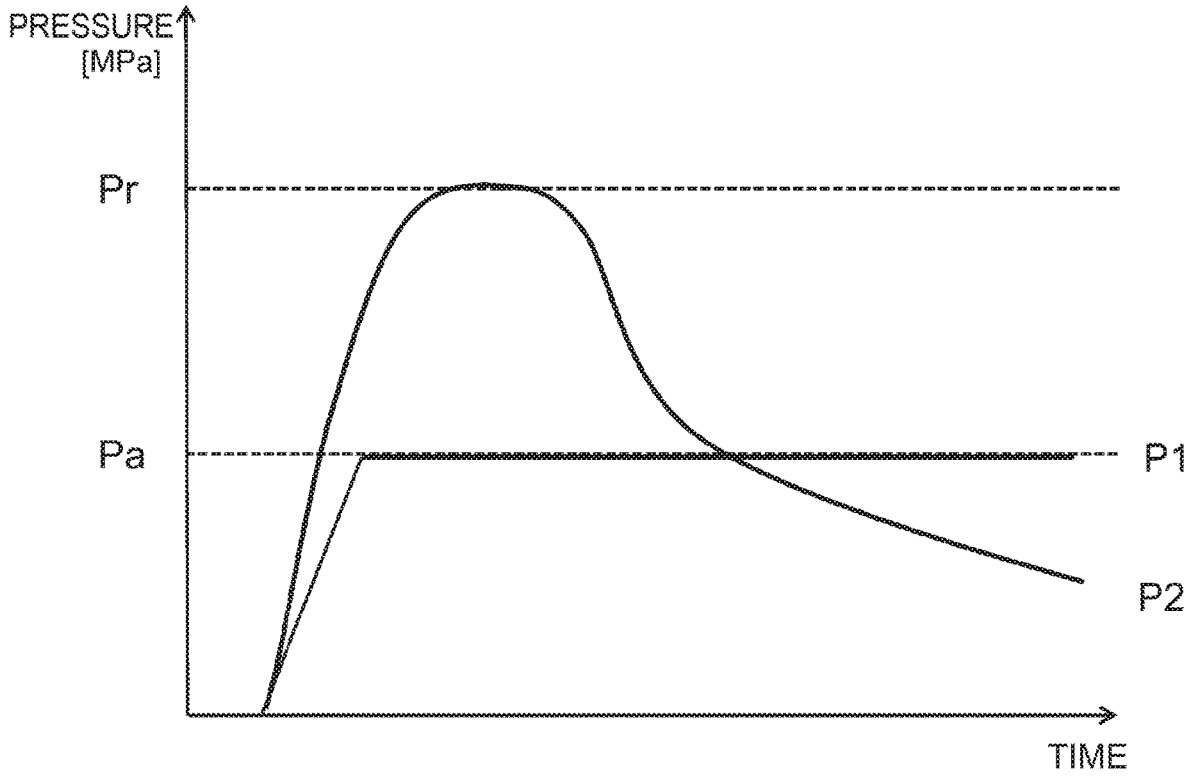
FIG. 6 is a graph of temporal changes in delivery pressure of each hydraulic pump when a boom operating pressure cut valve is shut off regardless of a load pressure at the time of a swing boom raising operation.

FIG. 6 shows pressure waveforms of delivery pressures of the first hydraulic pump 2 and the second hydraulic pump 3 when the boom operating pressure cut valve 13 is shut off in a state where the swing load pressure Pb is larger than the boom load pressure Pa during the swing boom raising operation. In the drawing, Pr is a set pressure of the swing relief valve 14. Also, P1 and P2 are the delivery pressures of the first hydraulic pump 2 and the second hydraulic pump 3, respectively.

As shown in the figure, at the start of the swing, the delivery pressure of the second hydraulic pump 3 rises to the set pressure Pr of the swing relief valve 14. As a result, the swing relief valve 14 is opened, and the hydraulic oil is discarded in the hydraulic tank 5, which is vain.

However, in the present embodiment, when the swing load pressure Pb is equal to or higher than the boom load pressure Pa as at the start of the swing, the boom operating pressure cut valve 13 is opened even when the swing boom raising operation is performed, and the operating pressure is led to the two control valves 6*a* and 6*c*. As a result, a hydraulic oil supply line (swing line) to the swing motor 7*b* and a hydraulic oil supply line (boom line) to the boom cylinder 7*a* are connected to each other in parallel as a parallel circuit and the hydraulic oil from the second hydraulic pump 3 is diverted to the swing motor 7*b* and the boom cylinder 7*a*.

When the boom load pressure Pa becomes larger than swing load pressure Pb, boom operating pressure cut valve 13 is shut off. The output of the operating pressure to the third control valve 6*c* installed on the swing line side is shut off, and the swing line and the boom line are separated from each other as an independent circuit. As a result, the first hydraulic pump 2 and the second hydraulic pump 3 are used for swing only and boom only, respectively.

Figure 7:
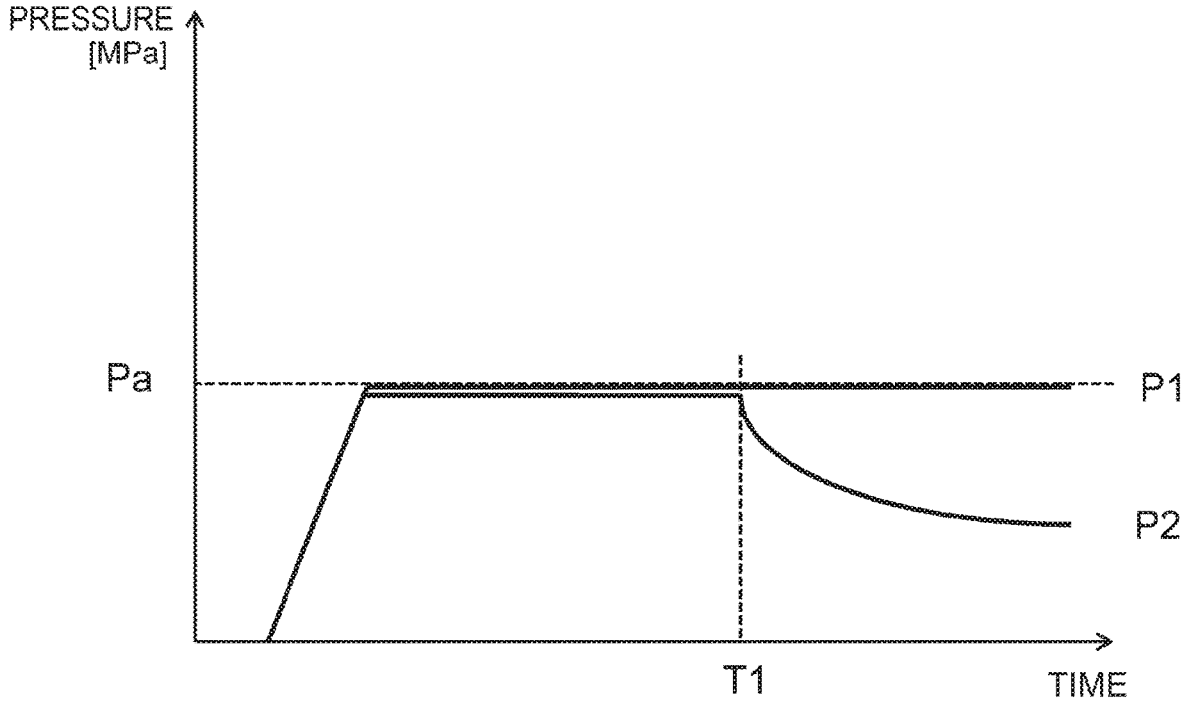
FIG. 7 is a graph of a temporal change in the delivery pressure of each hydraulic pump according to the first embodiment.

FIG. 7 shows the pressure waveforms of the delivery pressures of the first hydraulic pump 2 and the second hydraulic pump 3 at that time. As in FIG. 6, Pa is a boom load pressure, and P1 and P2 are a delivery pressure of the first hydraulic pump 2 and a delivery pressure of the second hydraulic pump 3, respectively. In addition, T1 is a time when the boom load pressure Pa becomes larger than the swing load pressure Pb.

When the boom operating pressure cut valve 13 is not shut off, that is, in the case of the parallel circuit, the pressure of the actuator is affected by a pressure of the actuator with a lower load pressure, and all become equal in the circuit. Therefore, as shown in the figure, the delivery pressure P1 of the first hydraulic pump 2 and the delivery pressure P2 of the second hydraulic pump 3 also have substantially the same value. Accordingly, the hydraulic oil flowing into the hydraulic oil tank 5 by the swing relief in the independent circuit merges into the boom cylinder 7*a*. Therefore, unnecessary consumption of energy by the swing relief is eliminated without operating the swing relief valve 14.

In addition, after T1, that is, when the boom load pressure Pa becomes larger than the swing load pressure Pb, the boom operating pressure cut valve 13 is shut off. As a result, the first hydraulic pump 2 and the second hydraulic pump 3 are respectively used for swing only and boom only, so that the delivery pressure of each pump can be controlled independently. As a result, the variable throttle for supplying the hydraulic oil into the swing motor 7*b*, which is required if the boom load pressure is higher than the swing load pressure in the parallel circuit, is not required.

As described above, according to the present embodiment, the parallel circuit and the independent circuit are selectively used according to the load pressure of the actuator at the time of the swing boom raising operation. This makes it possible to inhibit wasteful energy consumption in the swing relief which has occurred in the case of the independent circuit. In addition, the shortage of hydraulic oil supply to the boom cylinder can be eliminated. The wasteful consumption of the energy due to the passing through the variable throttle generated in the parallel circuit is also eliminated. Therefore, the energy can be used efficiently.

In the technique disclosed in Patent Literature 1, since only the pilot pressure is used to control the boom auxiliary control valve, it is difficult to perform a control according to changes in the load pressure of the boom cylinder and the load pressure of the swing motor. However, according to the present embodiment, since the load pressure of the boom cylinder and the load pressure of the swing motor are used, the optimal control can be performed according to the changes in those load pressures.

Moreover, those load pressures are parameters detected by the normal hydraulic drive device 60. For that reason, according to the present embodiment, the hydraulic drive device 60 capable of efficiently using the energy can be realized without adding a new configuration.

Second Embodiment

Next, a second embodiment of the present invention will be described. In the present embodiment, an acceleration sensor for detecting the acceleration of swing is provided. In the present embodiment, at the time of the swing boom raising operation, whether or not the operation is at the start of the high swing load pressure is detected by the acceleration sensor.

Hereinafter, the present embodiment will be described focusing on a configuration different from that of the first embodiment.

A hydraulic excavator 50 which is an example of a working machine according to the present embodiment basically has the same configuration as that of the hydraulic excavator 50 in the first embodiment.

Figure 8:
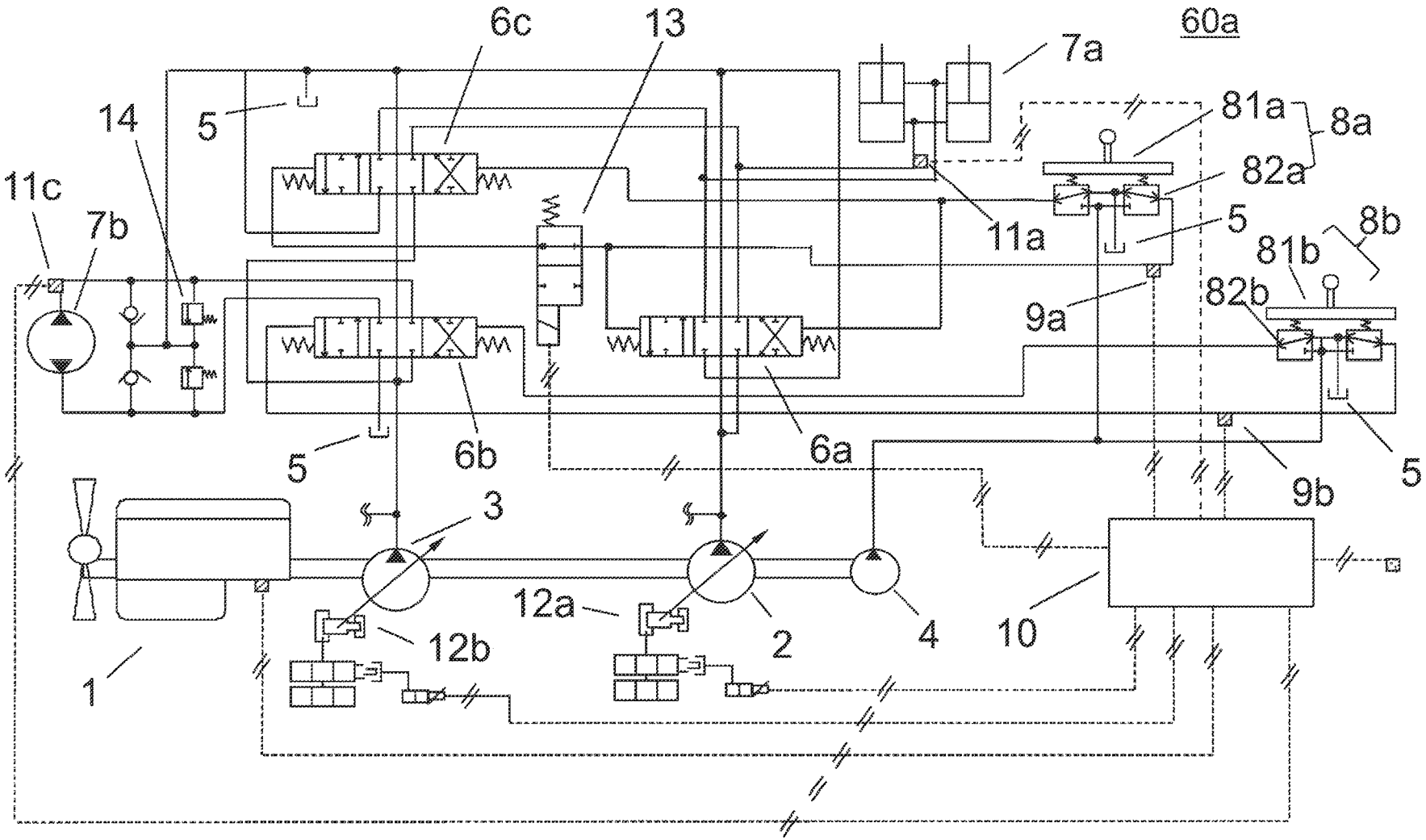
FIG. 8 is a block diagram of a hydraulic drive device according to a second embodiment.

A hydraulic drive device 60*a* according to the present embodiment is also the same basically as the hydraulic drive device 60 of the first embodiment. However, as shown in FIG. 8, in the present embodiment, an acceleration sensor 11*c* is provided instead of the swing motor pressure sensor 11*b*. The hydraulic drive device 60*a* may further include a swing motor pressure sensor 11*b*. Moreover, the processing content of the controller 10 according to the embodiment is also different from that in the first embodiment.

The acceleration sensor 11*c* detects an acceleration (referred to as a swing acceleration) of the swing motor 7*b* at predetermined time intervals. Each time the swing acceleration is detected, the acceleration sensor 11*c* transmits the detected swing acceleration to a controller 10.

As in the first embodiment, the controller 10 according to the present embodiment determines whether or not the swing motor 7*b* is in the swing boom raising operation by the boom operating pressure and the swing operating pressure. When it is determined that the swing motor 7*b* is in the swing boom raising operation, the controller 10 determines whether the swing motor 7*b* is immediately after the start of the swing boom raising operation or in a steady swing state. Then, when it is determined that the swing motor 7*b* is in the steady swing state, the controller 10 outputs a close command to the boom operating pressure cut valve 13.

Immediately after the start of the swing boom raising operation, the swing acceleration changes significantly. On the other hand, in the steady swing state, the swing acceleration is kept substantially constant. In other words, a constant speed swing is performed. The controller 10 according to the present embodiment uses the above operation to determine whether or not the swing motor 7*b* is just after the start or in the steady swing state depending on whether or not the constant speed swing is in progress. When it is determined that constant speed swing is in progress, the controller 10 assumes that the swing motor 7*b* is in the steady swing state, and the controller 10 outputs the close command to the boom operating pressure cut valve 13.

Specifically, when the controller 10 receives the swing acceleration from the acceleration sensor 11*c*, the controller 10 compares the received swing acceleration with a value of the swing acceleration received one time ago. When the latest swing acceleration (most recent acceleration) is equal to the swing acceleration received one time previously (previous acceleration), the controller 10 determines that the constant speed swing is in progress. The swing acceleration received one time ago is stored in a RAM or the like.

Further, the determination that the constant speed swing is in progress is not limited to the case where the latest acceleration and the previous acceleration coincide with each other. For example, when an absolute value of a difference between those accelerations is equal to or less than a predetermined threshold, the controller 10 may determine that the constant speed swing is in progress. In other words, if the amount of change in acceleration is within a predetermined range, the controller 10 may determine that constant speed swing is in progress.

Figure 9:
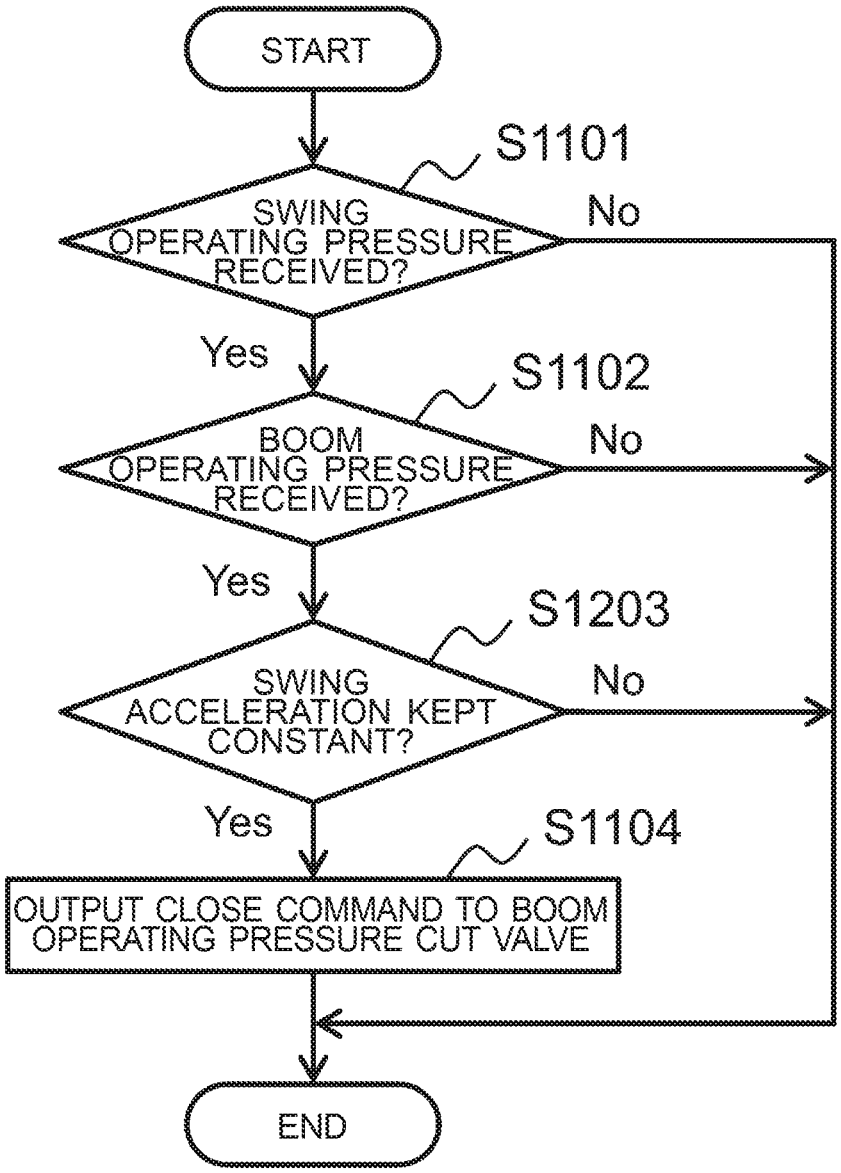
FIG. 9 is a flowchart of a cut valve control process according to the second embodiment.

Hereinafter, a flow of the cut valve control process performed by the controller 10 according to the present embodiment will be described with reference to a flow of FIG. 9. The same parts as those in the first embodiment will not be described. Further, the cut valve control process of the present embodiment is also performed at predetermined time intervals as in the first embodiment. In this example, it is assumed that a time interval at which the cut valve control process is performed is $\Delta t$, and the current time is t.

First, as in the first embodiment, the controller 10 discriminates whether or not the swing boom raising operation is in program in accordance with the swing operating pressure and the boom operating pressure (Steps S1101 and S1102). If the swing boom raising operation is not performed, the process is ended as it is.

On the other hand, when it is determined that the swing motor 7*b* is in the swing boom raising operation, the controller 10 determines whether or not the swing motor 7*b* is in the constant speed swing operation by the above method (Step S1203).

In Step S1203, the controller 10 compares a swing acceleration ac (t) acquired at a time t with a previously acquired swing acceleration $ac(t-\Delta t)$. Then, if both those accelerations are equal to each other, the controller 10 determines that the constant speed swing is in progress. Alternatively, if an absolute value of a difference between those swing accelerations is less than or equal to a predetermined threshold, the controller 10 determines that the constant speed swing is in progress.

If the constant speed swing is not in progress, the process is terminated as it is. On the other hand, when it is determined that the swing motor 7*b* is in the constant speed swing operation, the controller 10 outputs a close command to the boom operating pressure cut valve 13 (Step S1104), and the process is terminated.

As described above, according to the present embodiment, the acceleration sensor 11*c* which detects a swing acceleration of the swing motor 7*b* and outputs the swing acceleration to the controller 10 is further provided. When the amount of change in the swing acceleration falls within the predetermine range in the specific state describe above, the controller 10 discriminates that the steady swing state is in progress, and outputs the close command to the boom operating pressure cut valve 13.

Therefore, according to the present embodiment, as in the first embodiment, even during the swing boom raising operation, as in the case immediately after the start, when a large load is applied to the swing operation, the swing line and the boom line are connected in parallel. Then, when the swing motor 7*b* becomes in the steady swing state, both those lines are separated from each other to form an independent circuit. For that reason, similar to the first embodiment, an energy can be efficiently utilized.

For example, when it is determined by load pressure whether the swing motor 7*b* is immediately after the start or in the steady swing state, the load pressure of the actuator may rise under an influence of external force, such as when the front working device 22 is pressed against a wall or ground. However, according to the present embodiment, since the acceleration of the swing motor 7*b* is directly detected and the shutoff and conduction of the boom operating pressure cut valve 13 are controlled with the use of the result, the state of the swing motor 7*b* can be reflected on the control of the hydraulic drive device 60 with high accuracy.

Modification

Figure 10:
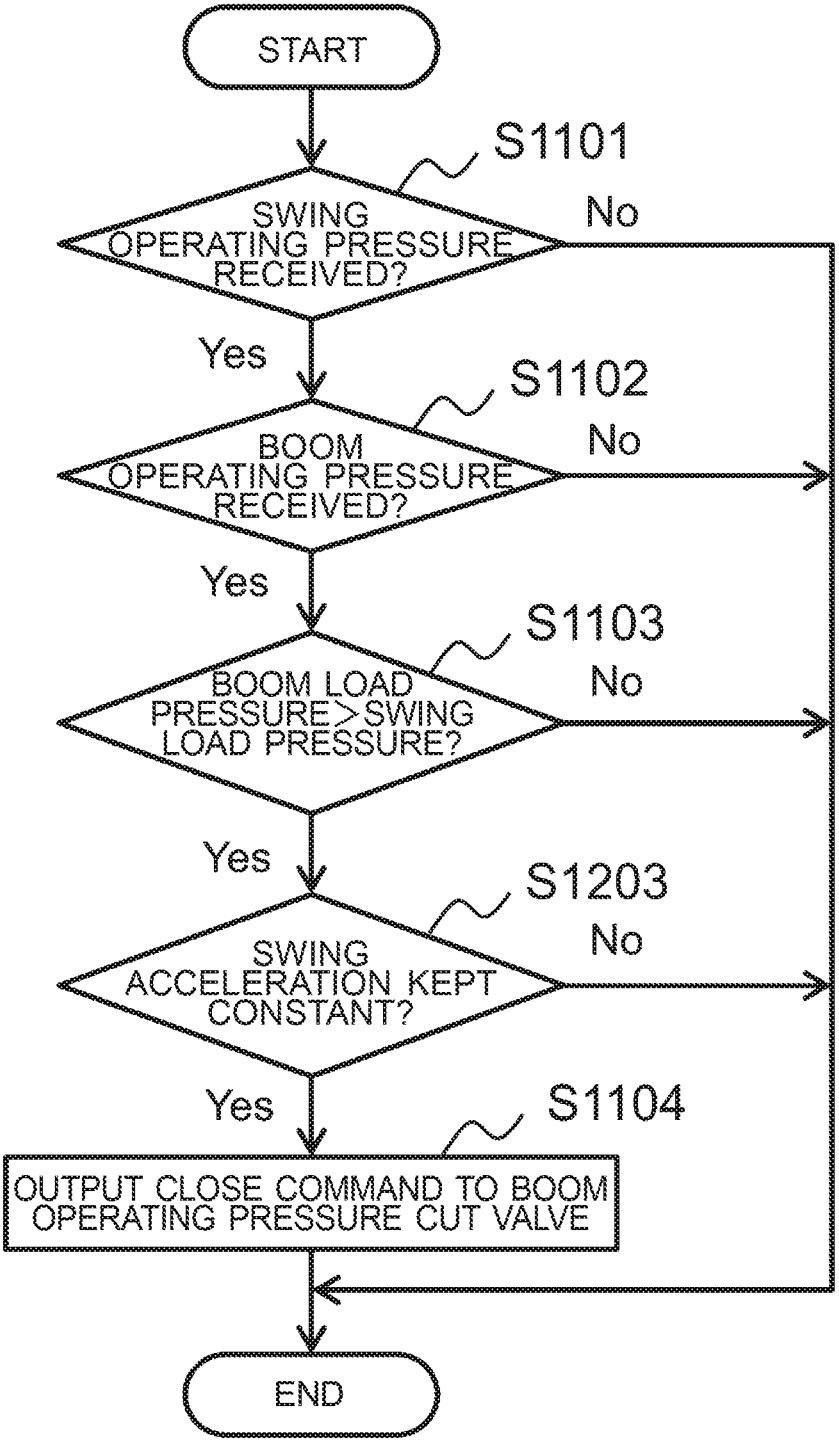
FIG. 10 is a flowchart of a cut valve control process according to a modification of the embodiment of the present invention.

Note that both the swing motor pressure sensor 11*b* and the acceleration sensor 11*c* may be provided. A flow of the cut valve control process by the controller 10 in that case is shown in FIG. 10.

First, similarly to the first embodiment, the controller 10 determines whether or not the swing motor is in the swing boom raising operation based on the swing operating pressure and the boom operating pressure (Steps S1101 and S1102). If it is determined that the swing boom raising operation is not in progress, the process is ended.

On the other hand, if it is determined that the swing boom raising operation is in progress, the controller 10 compares the boom load pressure with the swing load pressure (Step S1103). If the boom load pressure is equal to or less than the swing load pressure, the process is terminated.

If the boom load pressure is larger than the swing load pressure, the controller 10 determines whether or not a constant speed swing is in progress (Step S1203). If the constant speed swing is not in progress, the process is terminated as it is. This determination is performed in the same manner as in the second embodiment.

On the other hand, when it is determined that the swing motor is in the constant speed swing operation, the controller 10 outputs the close command to the boom operating pressure cut valve 13 (Step S1104), and the process is terminated.

According to the present modification, first, only when it is determined that the possibility of the steady swing state is high due to the load pressure, the determination is made based on acceleration. For that reason, it can be determined efficiently and accurately whether or not the operation is in the steady swing state. Therefore, according to the present modification, a control can be performed with higher accuracy, and the energy efficiency can be further improved.

Modification 2

Further, in each of the embodiments described above, the example in which the on-off solenoid valve (ON-OFF valve)

having only two states of open and close (shutoff and conduction) is used as the boom operating pressure cut valve 13 is described. However, the boom operating pressure cut valve 13 is not limited to the above example. For example, the boom operating pressure cut valve 13 may be configured by a spool valve having a metering.

Figure 11:
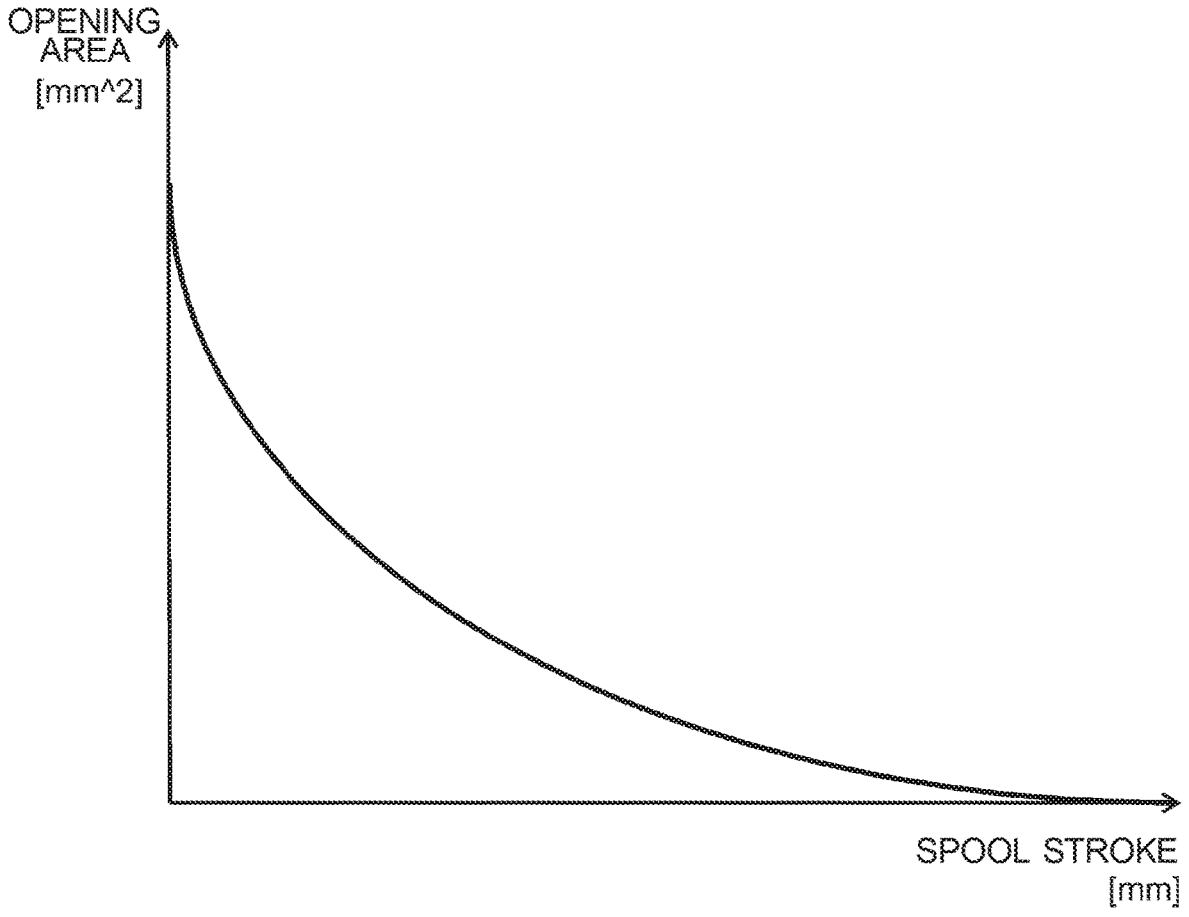
FIG. 11 is a graph of a metering characteristic of a boom operating pressure cut valve according to Modification 2 of the embodiment of the present invention.

FIG. 11 shows an example of a metering characteristic of the boom operating pressure cut valve 13 according to the present modification. In the drawing, the horizontal axis is a spool stroke [mm], and the vertical axis is an opening area [$mm^2$] of the boom operating pressure cut valve 13. As shown to the figure, the opening area of the boom operating pressure cut valve 13 according to the present modification monotonously reduces with an increase of a spool stroke. The spool stroke of the boom operating pressure cut valve 13 is determined according to an integrated value of the command current of the close command from the controller 10.

The controller 10 according to the present modification outputs the close command to the boom operating pressure cut valve 13 when the boom load pressure is larger than the swing load pressure. In this situation, the controller 10 continues to output the close command. As a result, the opening area of the boom operating pressure cut valve 13 becomes small according to the characteristic of FIG. 11.

According to the present modification, the energy can be efficiently used as in the above embodiments. Furthermore, according to the present modification, the boom operating pressure cut valve 13 has the metering characteristic. For that reason, switching between the parallel circuit and the independent circuit can be smoothly performed.

According to the present modification, when the boom operating pressure cut valve 13 is not completely closed, the parallel circuit is configured. At that time, as described above, the third control valve 6*c* can be controlled by the boom operating pressure cut valve 13. For that reason, the flow rate distribution of the hydraulic oil to the boom cylinder 7*a* and the swing motor 7*b* in the parallel circuit mode can be controlled by only the first control valve 6*a*, the second control valve 6*b*, and the third control valve 6*c* without changing the tilting of the pump. This enables a finer control of the flow rate.

Furthermore, in the conventional circuit, while attempting to drive multiple actuators, since the hydraulic oil is likely to flow into the actuator lower in the load pressure, a throttle is installed on a bleed line in order to adjust a balance of the pressure. However, with the use of the boom operating pressure cut valve 13 having a metering, the boom operating pressure cut valve 13 plays a role of the throttle. In other words, the third control valve 6*c* is controlled with the result that the boom operating pressure cut valve 13 realizes the role of the throttle. Therefore, the pressure balance can be controlled without providing a throttle on the bleed line. Therefore, the wasteful consumption of energy can be inhibited.

Modification 3

Furthermore, the spool opening degree of the boom operating pressure cut valve 13 may be adjusted according to the temperature of the hydraulic oil.

Figure 12:
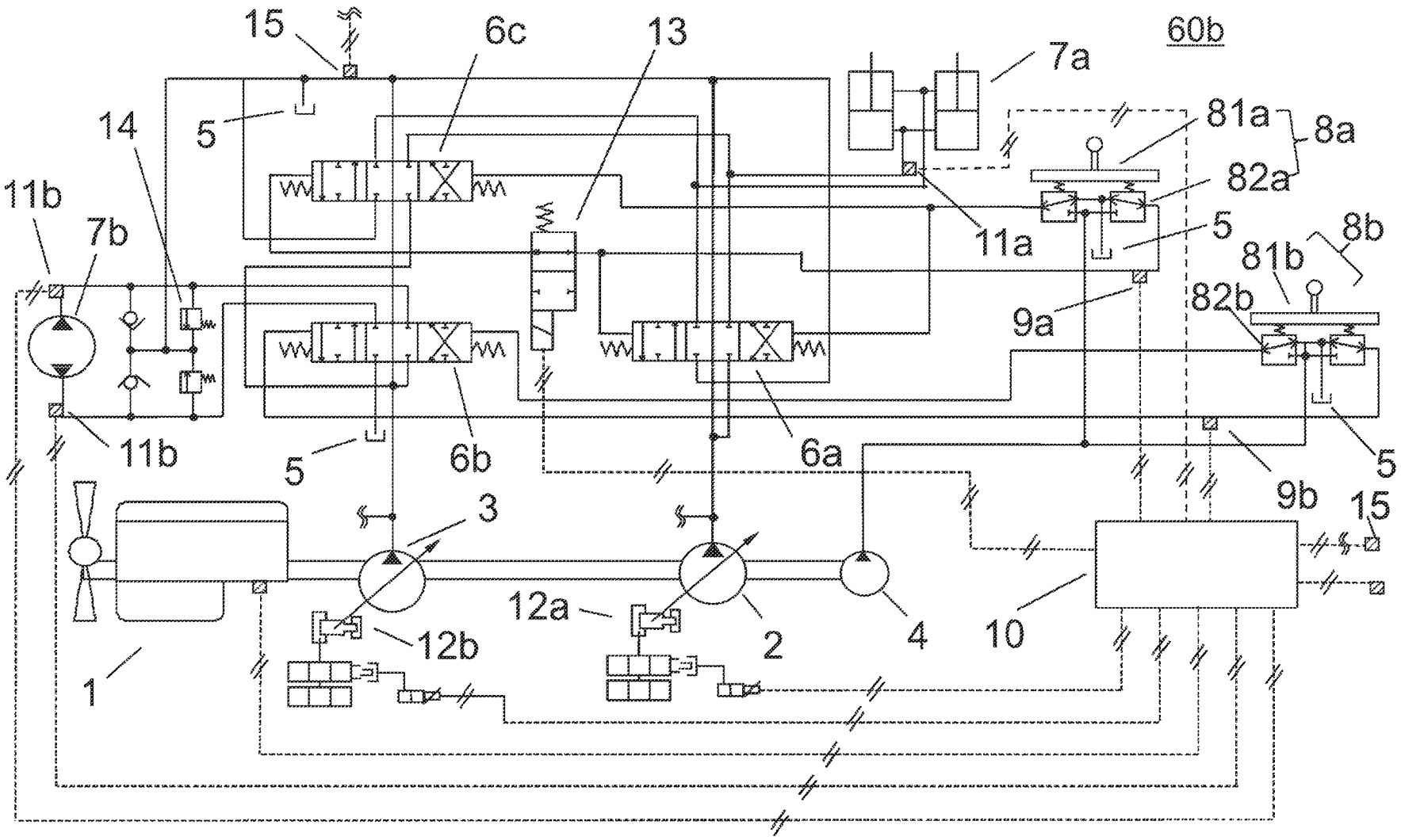
FIG. 12 is a configuration diagram of a hydraulic drive device according to Modification 3 of the embodiment of the present invention.

In that case, the hydraulic drive device 60*b*, as shown in FIG. 12, includes a temperature sensor 15 for detecting the temperature of the hydraulic oil. Then, the detection result of the temperature sensor 15 is output to the controller 10.

The controller 10 adjusts the spool opening degree of the boom operating pressure cut valve 13 according to the temperature of the hydraulic oil. In this example, the boom operating pressure cut valve 13 has a metering characteristic shown in FIG. 11 as in Modification 2.

The viscosity of the hydraulic oil is changed with temperature as described above. For that reason, a pressure loss of the hydraulic drive device 60*b* differs depending on a difference in the temperature. In other words, when the hydraulic oil is at a low temperature, the viscosity is high and the pressure loss of the hydraulic drive device 60*b* is high. Therefore, the opening degree of the boom operating pressure cut valve 13 is set to be larger so that the hydraulic oil can flow more easily as the temperature of the hydraulic oil is lower.

Therefore, in the present modification, the controller 10 outputs a command to the boom operating pressure cut valve 13 to open the opening degree of the boom operating pressure cut valve 13 more as the detected temperature of the hydraulic oil is lower. In this case, for example, the magnitude of the command current of the closing command to be output is set to be smaller than that in the case of Modification 2.

As described above, the opening degree of the boom operating pressure cut valve 13 is adjusted according to the temperature of the hydraulic oil, thereby being capable of avoiding a deviation from the target control value due to a change in the pressure loss caused by the change of the temperature. Therefore, a constant driving state can be maintained regardless of the temperature.

REFERENCE SIGNS LIST

1: prime mover, 2: first hydraulic pump, 3: second hydraulic pump, 4: pilot pump, 5: hydraulic oil tank, 6*a*: first control valve, 6*b*: second control valve, 6*c*: third control valve, 7*a*: boom cylinder, 7*b*: swing motor, 8*a*: boom operating device, 8*b*: swing operating device, 9*a*: boom operating pressure sensor, 9*b*: swing operating pressure sensor, 10: controller, 10*a*: controller, 11*a*: boom cylinder pressure sensor, 11*b*: swing motor pressure sensor, 11*c*: acceleration sensor, 12*a*: first regulator, 12*b*: second regulator, 13: boom operating pressure cut valve, 14: swing relief valve, 15: temperature sensor, 20: travel base, 21: upperstructure, 22: front working device, 23: traveling motor, 24: crawler, 25: boom, 26: arm, 27: bucket, 28: arm cylinder, 29: bucket cylinder, 30: cab, 31: motor chamber, 50: hydraulic excavator, 60: hydraulic drive device, 60*a*: hydraulic drive device, 60*b*: hydraulic drive device, 81*a*: control lever, 81*b*: control lever, 82*a*: control valve, 82*b*: control valve

The invention claimed is:

1. A working machine comprising: a travel base, an upperstructure that is swingably mounted on the travel base, a swing motor that drives the upperstructure, a boom that is provided in the upperstructure to be rotatable in a vertical direction, a boom cylinder that drives the boom, a hydraulic drive device that drives the swing motor and the boom cylinder, and a controller that controls the hydraulic drive device, wherein the hydraulic drive device includes:

a first hydraulic pump that supplies a hydraulic oil to the boom cylinder;

a second hydraulic pump that supplies the hydraulic oil to the swing motor;

a boom operating device that outputs a boom operating pressure which is a signal for operating the boom;

a swing operating device that outputs a swing operating pressure which is a signal for operating the upperstructure;

a first control valve that is disposed between the first hydraulic pump and the boom cylinder, and operates according to the boom operating pressure to control a direction and a flow rate of the hydraulic oil supplied from the first hydraulic pump to the boom cylinder;

a second control valve that is disposed between the second hydraulic pump and the swing motor and operates according to the swing operating pressure to control the direction and the flow rate of the hydraulic oil supplied from the second hydraulic pump to the swing motor;

a third control valve that is disposed between the second hydraulic pump and the boom cylinder in parallel to the second control valve, and shuts off a supply of the hydraulic oil to the boom cylinder from the second hydraulic pump and operates according to the boom operating pressure to control the direction and the flow rate of the hydraulic oil supplied to the boom cylinder from the second hydraulic pump, in a state where the boom operating pressure is not introduced;

an on-off solenoid valve which is disposed between the boom operating device and the third control valve and opens and closes based on a command current from the controller; and a relief valve that is provided between the second hydraulic pump and the swing motor, and is set a predetermined set pressure, in a specific state in which a boom raising operation and a swing operation of the upperstructure are performed at a same time to supply the hydraulic oil from the first hydraulic pump to the boom cylinder through the first control valve, and to supply the hydraulic oil from the second hydraulic pump to the swing motor through the second control valve, the controller outputs the command current for opening the on-off solenoid valve for introducing the boom operating pressure to the third control valve, and supplies a part of the hydraulic oil supplied to the swing motor from the second hydraulic pump to the boom cylinder through the third control valve so that a delivery pressure of the second hydraulic pump becomes a predetermined pressure lower than the predetermined set pressure, in case it is discriminated that the swing motor does not reach a steady swing state, until the swing motor reaches the steady swing state, and the controller outputs the command current for closing the on-off solenoid valve for limiting introduction of the boom operating pressure into the third control valve in case where it is discriminated that the swing motor is in the steady swing state so as to control independently the delivery pressure of the first hydraulic pump and the delivery pressure of the second hydraulic pump in the steady swing state.

2. The working machine according to claim 1, wherein the hydraulic drive device further includes:

a boom cylinder pressure sensor that detects a boom load pressure which is a load pressure of the boom cylinder and outputs the boom load pressure to the controller; and a swing motor pressure sensor that detects a swing load pressure which is the load pressure of the swing motor and outputs the swing load pressure to the controller, and the controller compares the boom load pressure with the swing load pressure in the specific state, and discriminates that the swing motor is in the steady swing state in case where the boom load pressure is greater than the swing load pressure.

3. The working machine according to claim 1, wherein the hydraulic drive device further comprises an acceleration sensor that detects a swing acceleration of the swing motor and outputs the swing acceleration to the controller, and the controller discriminates that the swing motor is in the steady swing state when an amount of change of swing acceleration falls within a predetermined range in the specific state.

4. The working machine according to claim 1, wherein the hydraulic drive device further includes:

a boom cylinder pressure sensor that detects a boom load pressure which is a load pressure of the boom cylinder and outputs the boom load pressure to the controller;

a swing motor pressure sensor that detects a swing load pressure which is a load pressure of the swing motor and outputs the swing load pressure to the controller; and an acceleration sensor that detects a swing acceleration of the swing motor and outputs the swing acceleration to the controller, and the controller discriminates that the swing motor is in the steady swing state in case, as a result of comparing the boom load pressure with the swing load pressure, the boom load pressure is larger than the swing load pressure, and an amount of change of the swing acceleration detected by the acceleration sensor falls within a predetermined range in the specific state.

5. The working machine according to claim 1, wherein the on-off solenoid valve has a metering characteristic in which the boom operating pressure to be conducted decreases as a spool stroke determined by an integrated value of the command current increases from the controller.

6. The working machine according to claim 5, further comprising a temperature sensor that detects a temperature of the hydraulic oil to output the detected temperature to the controller, wherein the controller decreases a magnitude of the command current to be output as the temperature detected by the temperature sensor is lower.

* * * * *